US011041494B2

(12) United States Patent
Hirata et al.

(10) Patent No.: US 11,041,494 B2
(45) Date of Patent: Jun. 22, 2021

(54) CO-ROTATING SCROLL COMPRESSOR

(71) Applicant: MITSUBISHI HEAVY INDUSTRIES, LTD., Tokyo (JP)

(72) Inventors: Hirofumi Hirata, Tokyo (JP); Takahide Ito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 184 days.

(21) Appl. No.: 16/470,763

(22) PCT Filed: Nov. 14, 2017

(86) PCT No.: PCT/JP2017/040831
§ 371 (c)(1),
(2) Date: Jun. 18, 2019

(87) PCT Pub. No.: WO2018/116696
PCT Pub. Date: Jun. 28, 2018

(65) Prior Publication Data

US 2019/0345934 A1 Nov. 14, 2019

(30) Foreign Application Priority Data

Dec. 21, 2016 (JP) ..... JP2016-247919

(51) Int. Cl.
*F04C 18/02* (2006.01)
*F04C 29/00* (2006.01)
(Continued)

(52) U.S. Cl.
CPC ..... *F04C 18/0215* (2013.01); *F04C 18/023* (2013.01); *F04C 29/0057* (2013.01);
(Continued)

(58) Field of Classification Search
CPC ..... F04C 18/0215; F04C 29/0057; F04C 18/023; F04C 18/0253; F01C 1/0215; F01C 17/063
See application file for complete search history.

(56) References Cited

U.S. PATENT DOCUMENTS 5,129,798 A 7/1992 Crum et al.
7,445,437 B1 * 11/2008 Kawazoe ..... F04C 18/02 418/55.1
(Continued)

FOREIGN PATENT DOCUMENTS

EP 3 480 465 5/2019
JP 5-79475 3/1993
(Continued)

OTHER PUBLICATIONS

Extended European Search Report dated Nov. 20, 2019 in corresponding European Patent Application No. 17883906.4.
(Continued)

*Primary Examiner* — Deming Wan
(74) *Attorney, Agent, or Firm* — Wenderoth, Lind & Ponack, L.L.P.

(57) ABSTRACT

A pin-ring mechanism that transmits driving force to cause a driving-side scroll member and a driven-side scroll member to perform rotational movement in a same direction at a same angular velocity is provided. A driving-side end plate includes a ring member installation hole into which a ring member is inserted and installed. The ring member installation hole includes a non-wall-side hole part and a wall-side hole part. The non-wall-side hole part is formed from a non-wall-side surface and has a diameter corresponding to an outer diameter of the ring member. The wall-side hole part is formed from a wall-side surface and has a diameter smaller than the outer diameter of the ring member.

6 Claims, 5 Drawing Sheets

(51) Int. Cl.
*F01C 1/02* (2006.01)
*F01C 17/06* (2006.01)

(52) U.S. Cl.
CPC ..... *F04C 2240/30* (2013.01); *F04C 2240/40* (2013.01); *F04C 2250/10* (2013.01); *F04C 2250/20* (2013.01)

(56) References Cited

U.S. PATENT DOCUMENTS

| | | | | |
|---|---|---|---|---|
| 9,719,510 | B2 * | 8/2017 | Fujioka | F01C 1/0253 |
| 9,869,181 | B2 * | 1/2018 | Fujioka | F03C 2/02 |
| 2002/0150485 | A1 | 10/2002 | Mori et al. | |
| 2002/0182094 | A1 * | 12/2002 | Mori | F04C 18/023 418/55.5 |
| 2005/0169788 | A1 * | 8/2005 | Komai | F04C 18/0253 418/55.6 |
| 2012/0288393 | A1 | 11/2012 | Sato | |

FOREIGN PATENT DOCUMENTS

| | | |
|---|---|---|
| JP | 2005-233342 | 9/2005 |
| JP | 4556183 | 10/2010 |
| JP | 2018-21465 | 2/2018 |
| WO | 02/053916 | 7/2002 |

OTHER PUBLICATIONS

International Search Report dated Feb. 20, 2018 in corresponding International Application No. PCT/JP2017/040831.

* cited by examiner

CO-ROTATING SCROLL COMPRESSOR

TECHNICAL FIELD

The present invention relates to a co-rotating scroll compressor.

BACKGROUND ART

A co-rotating scroll compressor has been well-known (refer to PTL 1). The co-rotating scroll compressor includes a driving-side scroll and a driven-side scroll that rotates in synchronization with the driving-side scroll, and causes a drive shaft causing the driving-side scroll to rotate and a driven shaft supporting rotation of the driven-side scroll to rotate in the same direction at the same angular velocity while the driven-shaft is offset by a revolving radius from the drive shaft. Furthermore, a synchronous driving mechanism that transmits driving force from the driving-side scroll member to the driven-side scroll member is provided to cause a driving-side scroll member and a driven-side scroll member to perform rotational movement in the same direction at the same angular velocity.

CITATION LIST

Patent Literature

[PTL 1]
Japanese Examined Patent Publication No. 4556183

SUMMARY OF INVENTION

Technical Problem

In a case where the synchronous driving mechanism is provided on an end plate of a scroll member, a diameter of the end plate is increased in order to secure an installation area of the synchronous driving mechanism.

The present invention is made in consideration of such circumstances, and an object of the present invention is to provide a co-rotating scroll compressor including a synchronous driving mechanism that makes it possible to reduce a diameter of an end plate of a scroll member.

Solution to Problem

To solve the above-described issues, a co-rotating scroll compressor according to the present invention adopts the following solutions.

A co-rotating scroll compressor according to an aspect of the present invention includes: a driving-side scroll member that is rotationally driven by a driving unit and includes a spiral driving-side wall disposed on a driving-side end plate; a driven-side scroll member that includes a driven-side wall corresponding to the driving-side wall, the driven-side wall being disposed on a driven-side end plate and engaging with the driving-side wall to form a compression space; and a synchronous driving mechanism that transmits driving force from the driving-side scroll member to the driven-side scroll member to cause the driving-side scroll member and the driven-side scroll member to perform rotational movement in a same direction at a same angular velocity, in which the synchronous driving mechanism includes a pin member and a ring member, the pin member being fixed to the driving-side wall and/or the driven-side wall and protruding toward the facing driven-side end plate and/or the driving-side end plate, and the ring member being fixed to the driving-side end plate and/or the driven-side end plate and including an inner peripheral surface coming into contact with the pin member, the driving-side end plate and/or the driven-side end plate includes a ring member installation hole into which the ring member is inserted and installed, and the ring member installation hole includes a non-wall-side hole part and a wall-side hole part, the non-wall-side hole part being formed from a non-wall-side surface of the driving-side end plate not provided with the driving-side wall and/or a non-wall-side surface of the driven-side end plate not provided with the driven-side wall and having a diameter corresponding to an outer diameter of the ring member, and the wall-side hole part being formed from a wall-side surface of the driving-side end plate provided with the driving-side wall and/or a wall-side surface of the driven-side end plate provided with the driven-side wall and having a diameter smaller than the outer diameter of the ring member.

The driving-side wall disposed on the end plate of the driving-side scroll and the corresponding driven-side wall of the driven-side scroll member engage with each other. The driving-side scroll member is rotationally driven by the driving unit, and the driving force transmitted to the driving-side scroll member is transmitted to the driven-side scroll member through the synchronous driving mechanism. As a result, the driven-side scroll member rotates as well as performs rotational movement in the same direction at the same angular velocity with respect to the driving-side scroll member. As described above, the co-rotating scroll compressor in which both of the driving-side scroll member and the driven-side scroll member rotate is provided.

The synchronous driving mechanism is formed of the pin member and the ring member, and the ring member is installed in the ring member installation hole of the end plate. The ring member installation hole includes the non-wall-side hole part that is formed from the non-wall-side surface and has the diameter corresponding to the outer diameter of the ring member. The ring member is installed by being inserted into the non-wall-side hole part from the non-wall side. In addition, the ring member installation hole includes the wall-side hole part having the diameter smaller than the outer diameter of the ring member on the wall side. The pin member is disposed such that an outer peripheral surface of the pin member comes into contact with the inner peripheral side of the ring member through the wall-side hole part.

The wall-side hole part preferably has a small area because the wall-side hole part deteriorates compression efficiency if opened at a position where a compression space is formed. In contrast, the non-wall-side hole part is high in flexibility of an installation position because the non-wall-side hole part is not opened to the compression space. Therefore, the diameter of the wall-side hole part is made smaller than the outer diameter of the ring member, and the area of the wall-side hole part is made smaller than the area of the non-wall-side hole part that has the diameter corresponding to the outer diameter of the ring member. This makes it possible to position the ring member on a center side of each of the end plates as compared with a case where a hole part having the diameter corresponding to the outer diameter of the ring member is formed on the wall side, which allows for downsizing of the end plates.

As the ring member, for example, a rolling bearing or a sliding bearing is used.

Furthermore, in the co-rotating scroll compressor according to the aspect of the present invention, a plurality of the driving-side walls are provided at predetermined angular intervals around a center of the driving-side end plate, the driven-side walls in a number corresponding to the number of driving-side walls are provided at predetermined angular intervals around a center of the driven-side end plate, and the pin member is provided in a range from a winding end of each of the driving-side walls and/or the driven-side walls to an angle that is obtained by dividing n (rad) by the number of the driving-side walls or the number of the driven-side walls.

In the range from the winding end of each of the walls to the angle that is obtained by dividing n (rad) by the number of the walls provided on one end plate, the back side (outside in radial direction) of each of the walls does not come into contact with the corresponding wall. Accordingly, the pin member is preferably provided within the angle range.

Furthermore, in the co-rotating scroll compressor according to the aspect of the present invention, the pin member is provided in an angle range excluding a position of each of the driving-side walls and/or the driven-side walls.

When the pin member is provided within the angle range excluding the position of the winding end of each of the walls, the pin member can be positioned close to the center side. This avoids a situation in which the end plates are inevitably increased in diameter in order to install the pin member and the ring member, which allows for downsizing of the end plates.

Furthermore, in the co-rotating scroll compressor according to the aspect of the present invention, the pin member is provided on each of the driving-side wall and the driven-side wall.

When the pin members are installed while being distributed to both of the walls, the area where the pin members and the ring members are installable is increased on each of the scroll members. This makes it possible to increase the total number of the pin members and the ring members. As a result, the angle range where one pair of the pin member and the ring member bears a load is reduced, load fluctuation and rotation fluctuation are reduced, and noise caused by the pin members and the ring members is accordingly reduced. Furthermore, since the area where the pin members and the ring members are installable is increased on each of the scroll members, the pin members and the ring members can be installed at the desired radial positions, and the load fluctuation applied to the pin members and the ring members can be reduced.

Advantageous Effects of Invention

The ring member of the synchronous driving mechanism including the pin member and the ring member is installed by being inserted from the non-wall side, and the diameter of the hole part opened to the wall side is made smaller than the outer diameter of the ring member. This makes it possible to locate the installation position of the synchronous driving mechanism at a position close to the center of the end plate, and to reduce the diameter of the end plate of each of the scroll members.

DESCRIPTION OF EMBODIMENTS

First Embodiment

A first embodiment of the present invention is described below with reference to FIG. 1, etc.

Figure 1:
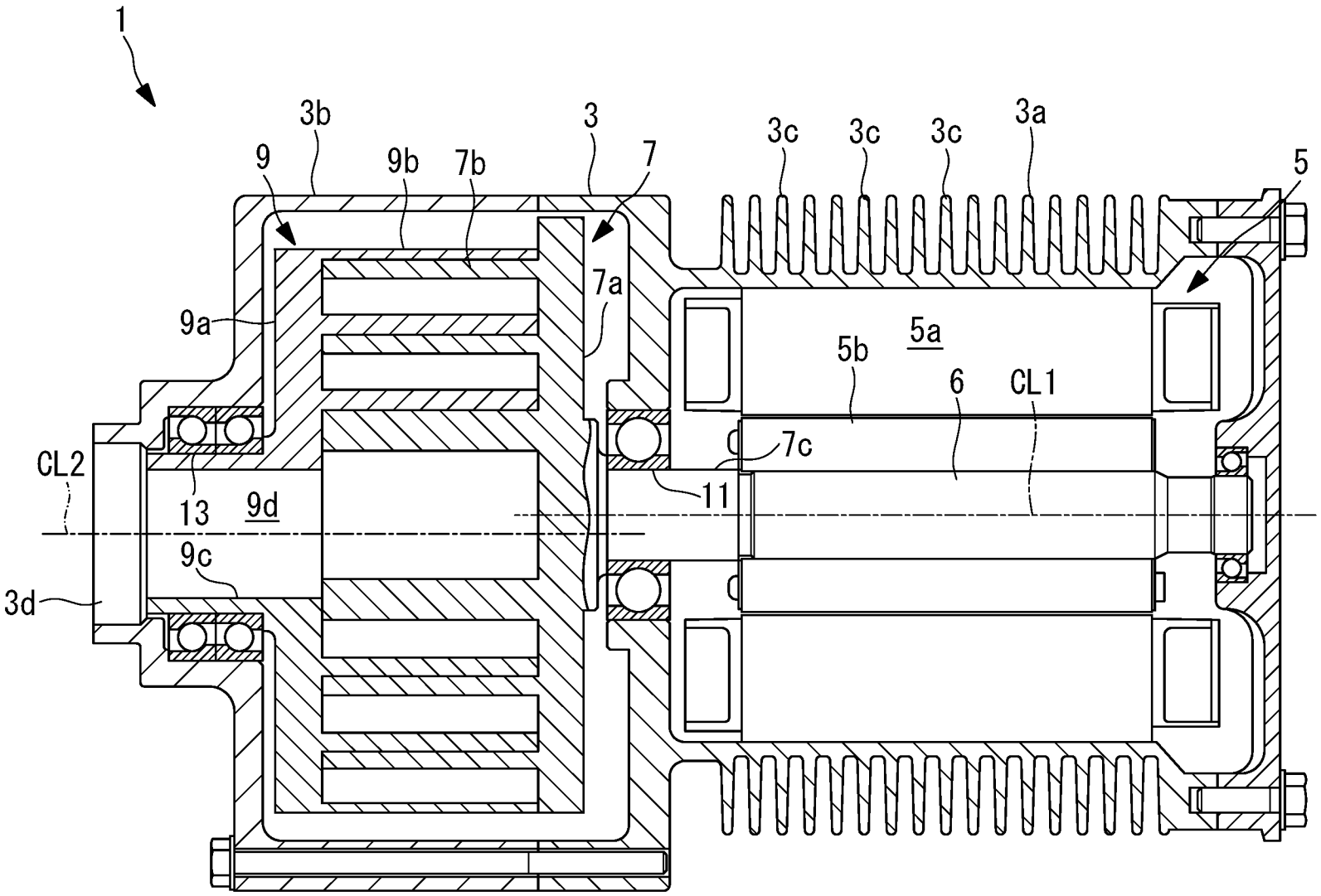
FIG. 1 is a vertical cross-sectional view illustrating a co-rotating scroll compressor according to an embodiment of the present invention.

FIG. 1 illustrates a co-rotating scroll compressor 1. The co-rotating scroll compressor 1 can be used as, for example, a supercharger that compresses combustion air to be supplied to an internal combustion engine such as a vehicle engine. Furthermore, the co-rotating scroll compressor 1 can be used as a compressor that compresses a refrigerant to be used in an air conditioner, or a compressor that compresses air used in a brake of a railway vehicle.

The co-rotating scroll compressor 1 includes a housing 3, a motor (driving unit) 5 accommodated on one end side in the housing 3, and a driving-side scroll member 7 and a driven-side scroll member 9 that are accommodated on the other end side in the housing 3.

The housing 3 has a substantially cylindrical shape, and includes a motor accommodation portion 3*a* that accommodates the motor 5, and a scroll accommodation portion 3*b* that accommodates the scroll members 7 and 9.

A cooling fin 3*c* to cool the motor 5 is provided on an outer periphery of the motor accommodation portion 3*a*. A discharge opening 3*d* from which compressed air is discharged is provided at an end part of the scroll accommodation portion 3*b*. Note that, although not illustrated in FIG. 1, the housing 3 includes an air suction opening from which air is sucked in.

The motor 5 is driven by being supplied with power from an unillustrated power supply source. Rotation of the motor 5 is controlled by an instruction from an unillustrated control unit. A stator 5*a* of the motor 5 is fixed to an inner periphery of the housing 3. A rotor 5*b* of the motor 5 rotates around a driving-side rotation axis CL1. A driving shaft 6 that extends on the driving-side rotation axis CL1 is connected to the rotor 5*b*. The driving shaft 6 is connected to the driving-side scroll member 7.

The driving-side scroll member 7 includes a driving-side end plate 7*a* and spiral driving-side walls 7*b* that are disposed on one side of the driving-side end plate 7*a*. The driving-side end plate 7*a* is connected to a driving-side shaft portion 7*c* connected to the driving shaft 6, and extends in a direction orthogonal to the driving-side rotation axis CL1. The driving-side shaft portion 7*c* is provided so as to be rotatable with respect to the housing 3 through a driving-side bearing 11 that is a ball bearing.

The driving-side end plate 7*a* has a substantially disc shape in a planar view. The driving-side scroll member 7 includes two driving-side walls 7*b* each formed in a spiral shape, namely, two lines of driving-side walls 7*b*. The two lines of driving-side walls 71*b* are disposed at an equal interval around the driving-side rotation axis CL1.

The driven-side scroll member 9 is disposed so as to engage with the driving-side scroll member 7, and includes a driven-side end plate 9*a* and spiral driven-side walls 9*b* that are disposed on one side of the driven-side end plate 9*a*. A driven-side shaft portion 9*c* that extends in a driven-side rotation axis CL2 direction is connected to the driven-side end plate 9*a*. The driven-side shaft portion 9*c* is provided so as to be rotatable with respect to the housing 3 through a driven-side bearing 13 that is a double-row ball bearing.

Figure 2:
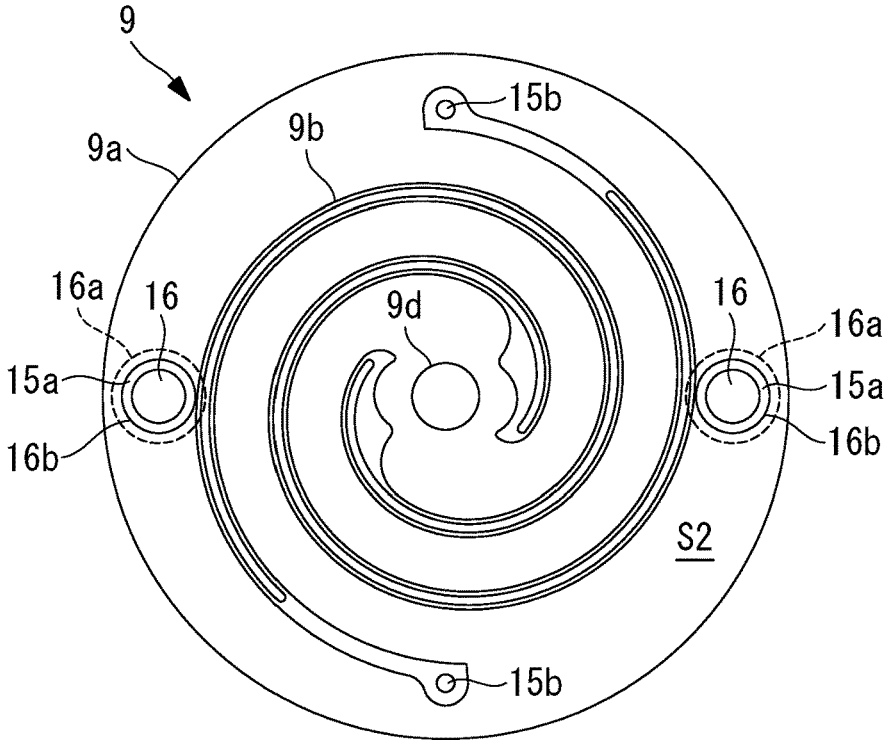
FIG. 2 is a plan view illustrating a driven-side scroll member in FIG. 1.

As illustrated in FIG. 2, the driven-side end plate 9*a* has a substantially disc shape in a planar view. The driven-side scroll member 9 includes two driven-side walls 9*b* each formed in a spiral shape, namely, two lines of driven-side walls 9*b*. The two lines of driven-side walls 9*b* are disposed at an equal interval around the driven-side rotation axis CL2. A discharge port 9*d* that discharges the compressed air is provided at a substantially center of the driven-side end plate 9*a*. The discharge port 9*d* communicates with the discharge opening 3*d* provided in the housing 3.

As described above, as illustrated in FIG. 1, the driving-side scroll member 7 rotates around the driving-side rotation axis CL1, and the driven-side scroll member 9 rotates around the driven-side rotation axis CL2. The driving-side rotation axis CL1 and the driven-side rotation axis CL2 are offset by a distance enough to form a compression chamber.

Figure 3:
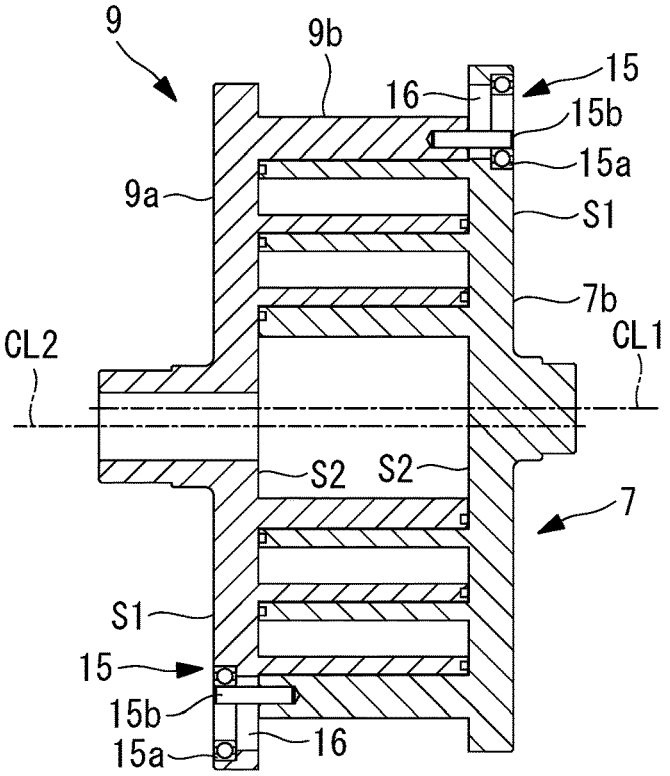
FIG. 3 is a vertical cross-sectional view illustrating a scroll member provided with pin-ring mechanisms.

As illustrated in FIG. 2 and FIG. 3, a plurality of pin-ring mechanisms 15 are provided between the driving-side scroll member 7 and the driven-side scroll member 9. The pin-ring mechanisms 15 are used as synchronous driving mechanisms that transmit driving force from the driving-side scroll member 7 to the driven-side scroll member 9 to cause both of the scroll members 7 and 9 to perform rotational movement in the same direction at the same angular velocity.

More specifically, as illustrated in FIG. 2, each of the pin-ring mechanisms 15 includes a ring member 15*a* that is a ball bearing (rolling bearing), and a pin member 15*b*. As illustrated in FIG. 3, the pin-ring mechanisms 15 are installed while being distributed to both of the driving-side scroll member 7 and the driven-side scroll member 9. The pin members 15*b* are fixed while being inserted into respective attachment holes provided at front ends of the walls 9*b* and 7*b*.

In the present embodiment, two ring members 15*a* and two pin members 15*b* are provided on each of the scroll members 7 and 9. Each of the pin members 15*b* is provided at a winding end that is an outer peripheral end of each of the walls 7*b* and 9*b*. Each of the ring members 15*a* is provided at a position shifted toward the inner peripheral side by about 90 degrees from each of the pin members 15*b*.

Figure 4:
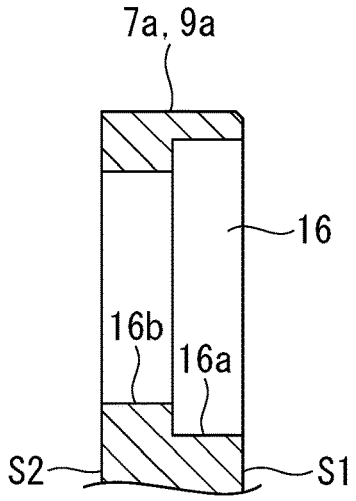
FIG. 4 is a partial enlarged vertical cross-sectional view illustrating a ring member installation hole.

The ring members 15*a* are fixed to respective ring member installation holes 16 provided on the end plates 7*a* and 9*a*. As illustrated in FIG. 4, each of the ring member installation holes 16 includes a non-wall-side hole part 16*a* and a wall-side hole part 16*b*. The non-wall-side hole parts 16*a* are opened to a non-wall-side surface S1 of each of the end plates 7*a* and 9*a* not provided with the walls 7*b* and 9*b*, and are each formed up to a middle position in the thickness direction of each of the end plates 7*a* and 9*a*. The wall-side hole parts 16*b* are opened to a wall-side surface S2 of each of the end plates 7*a* and 9*a* provided with the walls 7*b* and 9*b*, and are each formed up to a middle position in the thickness direction of each of the end plates 7*a* and 9*a*.

Each of the non-wall-side hole parts 16*a* has a diameter corresponding to an outer diameter of each of the ring members 15*a*, and is mated with an outer ring of the corresponding ring member 15*a*.

Each of the wall-side hole parts 16*b* has a diameter smaller than the outer diameter (outer diameter of outer ring) of each of the ring members 15*a*, namely, smaller than an inner diameter of each of the non-wall-side hole parts 16*a*. Furthermore, the diameter of each of the wall-side hole parts 16*b* is equal to or larger than an inner diameter (inner diameter of inner ring) of each of the ring members 15*a*. Each of the ring members 15*a* is fixed at a position where the ring member 15*a* is abutted on a step between the corresponding non-wall-side hole part 16*a* and the corresponding wall-side hole part 16*b*.

Both the scroll members 7 and 9 move while a side peripheral surface of a front end of each of the pin members 15*b* is in contact with an inner peripheral surface of the inner ring of the corresponding ring member 15*a*, which causes both of the scroll members 7 and 9 to perform rotational movement in the same direction at the same angular velocity.

The co-rotating scroll compressor 1 having the above-described configuration operates in the following manner.

When the driving shaft 6 rotates around the driving-side rotation axis CL1 by the motor 5, the driving-side shaft portion 7*c* connected to the driving shaft 6 also rotates, and the driving-side scroll member 7 accordingly rotates around the driving-side rotation axis CL1. When the driving-side scroll member 7 rotates, the driving force is transmitted to the driven-side scroll member 9 through the pin-ring mechanisms 15, and the driven-side scroll member 9 rotates around the driven-side rotation axis CL2. At this time, the pin members 15*b* of the pin-ring mechanisms 15 move while being in contact with the respective ring members 15*a*, which causes the both scroll members 7 and 9 to perform rotational movement in the same direction at the same angular velocity.

When the scroll members 7 and 9 perform rotational movement, the air sucked through the air suction opening of the housing 3 is sucked in from the outer peripheral side of each of the scroll members 7 and 9, and is taken into compression chambers formed by the scroll members 7 and 9. A volume of each of the compression chambers is reduced as each of the compression chambers moves toward the center, which compresses the air. The air compressed in the above-described manner passes through the discharge port 9*d* of the driven-side scroll member 9 and is discharged to outside from the discharge opening 3*d* of the housing 3. The discharged compressed air is guided to an unillustrated internal combustion engine, and is used as combustion air.

As described above, the present embodiment achieves the following action effects.

Each of the ring member installation holes 16 in which the respective members 15*a* are installed includes the non-wall-side hole part 16*a* that is formed from the non-wall-side surface S1 and has the diameter corresponding to the outer diameter of each of the ring members 15*a*. The ring members 15*a* are installed by being inserted into the respective non-wall-side hole parts 16*a* from the non-wall-side surface S1 side. In addition, each of the ring member installation holes 16 includes the wall-side hole part 16*b* that has the diameter smaller than the outer diameter of each of the ring members 15*a* on the wall-side surface S2 side. Each of the pin members 15*b* is disposed such that the outer peripheral surface of the pin member 15*b* comes into contact with the inner peripheral side of the corresponding ring member 15*a* through the wall-side hole part 16*b*.

Each of the wall-side hole parts 16*b* preferably has a small area because the wall-side hole parts 16*b* deteriorate compression efficiency if opened at positions where the compression space is formed. In contrast, the non-wall-side hole parts 16*a* are high in flexibility of installation positions because the non-wall-side hole parts 16*a* are not opened to the compression space. Therefore, the diameter of each of the wall-side hole parts 16*b* is made smaller than the outer diameter of each of the ring members 15*a*, and the area of each of the wall-side hole parts 16*b* is made smaller than the area of each of the non-wall-side hole parts 16*a* each having the diameter corresponding to the outer diameter of each of the ring members 15*a*. This makes it possible to position the ring members 15*a* on the center side of each of the end plates, which allows for downsizing of the end plates.

Figure 5:
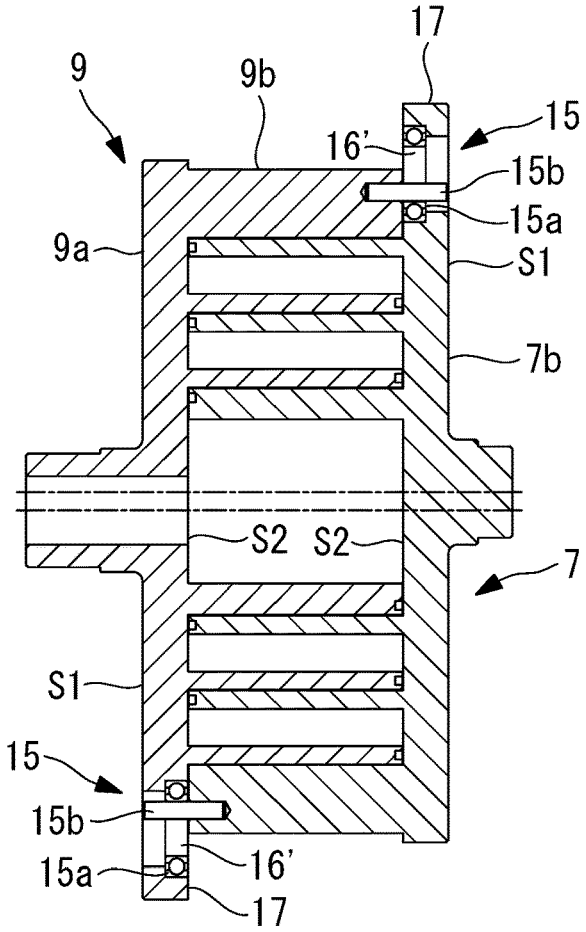
FIG. 5 is a vertical cross-sectional view illustrating a scroll member provided with pin-ring mechanisms as a comparative example.
Figure 6:
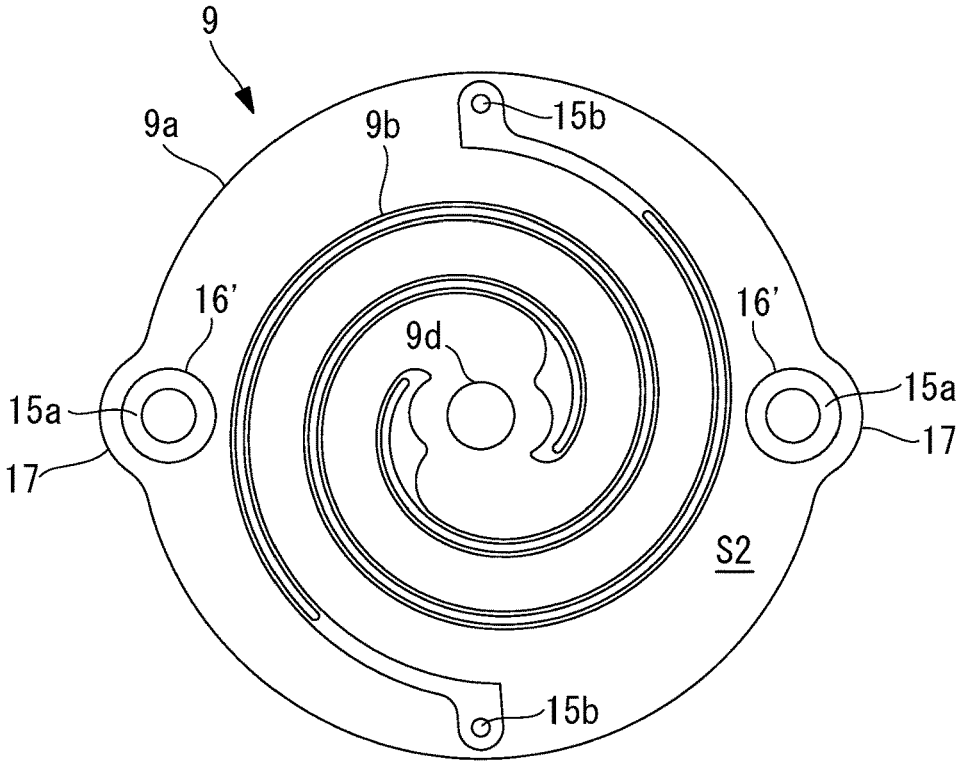
FIG. 6 is a plan view illustrating a driven-side scroll member in FIG. 5.

FIG. 5 and FIG. 6 each illustrate a case where hole parts each having a diameter corresponding to the outer diameter of each of the ring members 15*a* are formed on the wall-side surface S2, as a comparative example. In this case, holes each having a large diameter are opened to the wall-side surface S2. Therefore, in this case, ring member installation holes 16' are inevitably provided at positions separated from the walls 7*b* and 9*b*. As a result, as illustrated in FIG. 6, protrusions 17 protruding in a radial direction are provided at positions corresponding to the ring member installation holes 16', which increases the outer diameter of each of the end plates 7*a* and 9*a*.

The pin members 15*b* are distributed and installed on both of the walls 7*b* and 9*b*. Therefore, the area where the pin-ring mechanisms 15 are installable is increased on each of the scroll members 7 and 9, which can increase the total number of the pin-ring mechanisms 15. As a result, an angle range where one pin-ring mechanism 15 bears the load is reduced and the load fluctuation and rotation fluctuation are reduced, which makes it possible to reduce noise caused by the pin-ring mechanisms 15. Furthermore, since the area where the pin-ring mechanisms 15 are installable is increased on each of the scroll members 7 and 9, the pin-ring mechanisms 15 can be installed at desired radial positions, and the load fluctuation applied to the pin-ring mechanisms 15 can be reduced.

Figure 7:
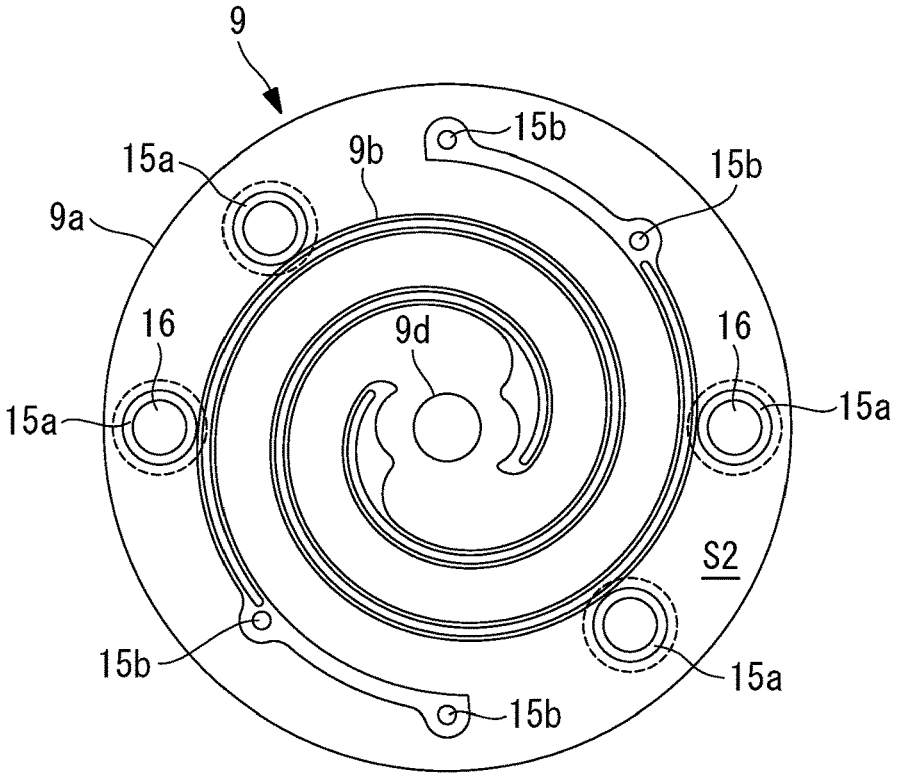
FIG. 7 is a plan view illustrating a driven-side scroll member as a modification.

For example, as illustrated in FIG. 7, eight pin-ring mechanisms 15 may be provided. In this figure, the driven-side scroll member 9 is illustrated, and four ring members 15*a* and four pin members 15*b* are provided on the driven-side scroll member 9.

Figure 8:
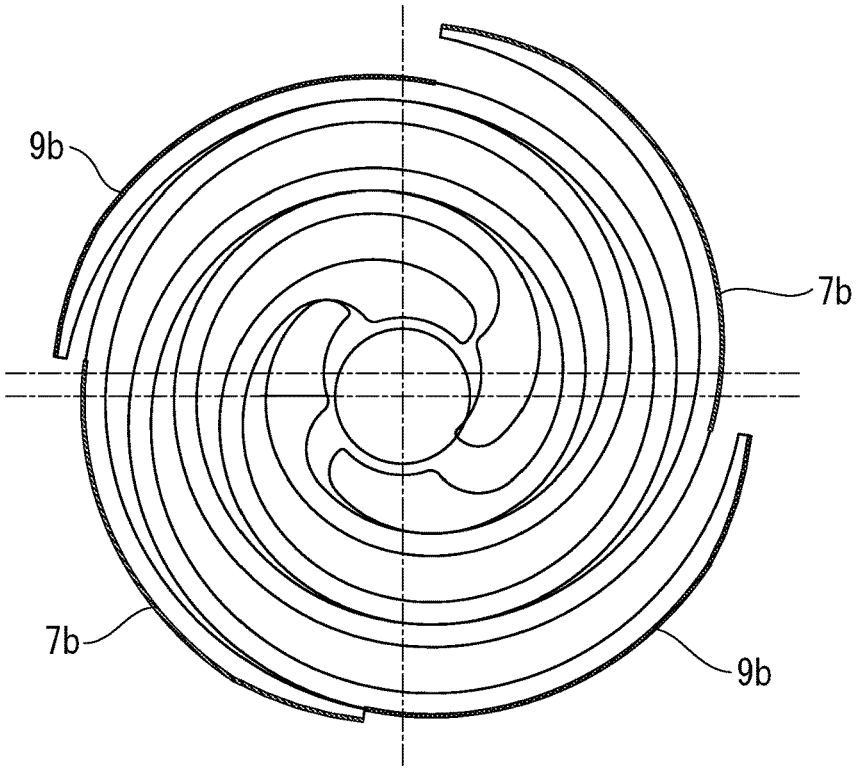
FIG. 8 is a diagram illustrating a state where two scroll members engage with each other.

Furthermore, as illustrated in FIG. 8, back sides (outside in radial direction) of the respective walls 7*b* and 9*b* do not come into contact with the corresponding walls 9*b* and 7*b* within a range from the winding end of each of the walls 7*b* and 9*b* to an angle obtained by dividing n (rad) by the number of lines of the walls 7*b* provided on the end plate 7*a* or by the number of lines of the walls 9*b* provided on the end plate 9*a*. In FIG. 8, the two walls 7*b* are provided on the end plate 7*a* and the two walls 9*b* are provided on the end plate 9*a*. Therefore, the back sides of the respective walls 7*b* and 9*b* do not come into contact with the corresponding walls 9*b* and 7*b* within the range of n/2 (90 degrees). In FIG. 8, the angle range is illustrated by a thick line. Accordingly, the pin members 15*b* are preferably provided within the angle range.

Figure 9:
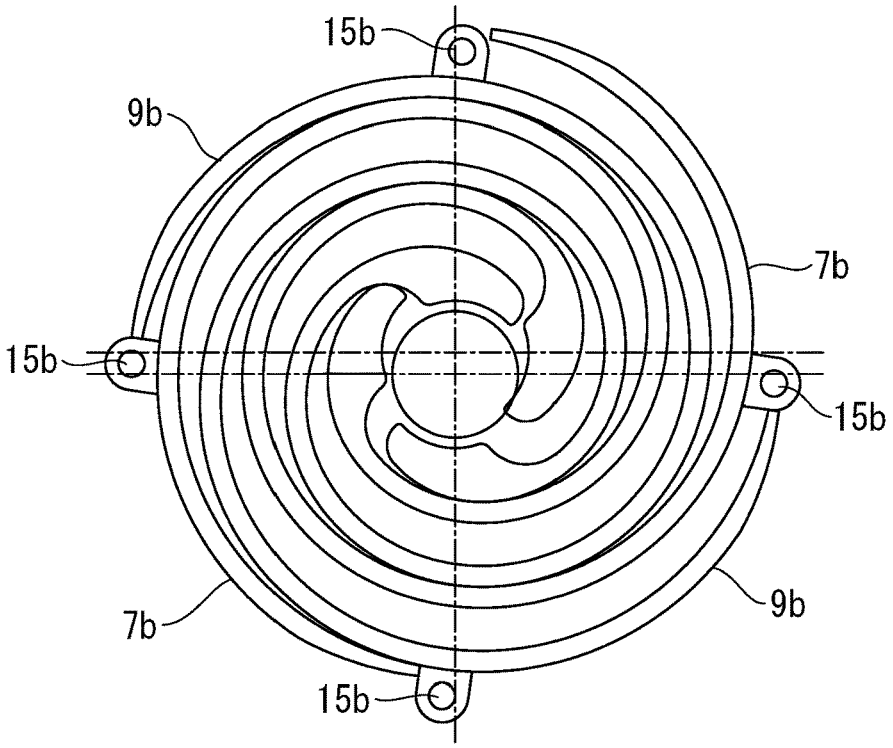
FIG. 9 is a diagram illustrating a scroll member as another modification.

FIG. 9 illustrates a modification in which each of the pin members 15*b* is provided at a position that is within the angle range illustrated in FIG. 8 excluding the position of the winding end of each of the walls 7*b* and 9*b*. When each of the pin members 15*b* is provided within the angle range excluding the position of the winding end of each of the walls 7*b* and 9*b*, the pin members 15*b* can be positioned closer to the center side. This avoids a situation in which the end plates 7*a* and 9*a* are inevitably increased in diameter in order to install the pin-ring mechanisms 15, which allows for downsizing of the end plates 7*a* and 9*a*.

Note that the above-described embodiment is described while the ball bearings are used as the ring members 15*a*; however, the ring members 15*a* may be sliding bearings.

REFERENCE SIGNS LIST

1 Co-rotating scroll compressor
3 Housing
3*a* Motor accommodation portion
3*b* Scroll accommodation portion
3*c* Cooling fin
3*d* Discharge opening
5 Motor (driving unit)
5*a* Stator
5*b* Rotor
6 Driving shaft
7 Driving-side scroll member
7*a* Driving-side end plate
7*b* Driving-side wall
7*c* Driving-side shaft portion
9 Driven-side scroll member
9*a* Driven-side end plate
9*b* Driven-side wall
9*c* Driven-side shaft portion
9*d* Discharge port
11 Driving-side bearing
13 Driven-side bearing
15 Pin-ring mechanism (synchronous driving mechanism)
15*a* Ring member
15*b* Pin member
16 Ring member installation hole
16*a* Non-wall-side hole part
16*b* Wall-side hole part
17 Protrusion
S1 Non-wall-side surface
S2 Wall-side surface

The invention claimed is:

1. A co-rotating scroll compressor, comprising:

a driving-side scroll member that is rotationally driven by a driving unit and includes a spiral driving-side wall disposed on a driving-side end plate;

a driven-side scroll member that includes a driven-side wall corresponding to the driving-side wall, the driven-side wall being disposed on a driven-side end plate and engaging with the driving-side wall to form a compression space; and a synchronous driving mechanism that transmits driving force from the driving-side scroll member to the driven-side scroll member to cause the driving-side scroll member and the driven-side scroll member to perform rotational movement in a same direction at a same angular velocity, wherein the synchronous driving mechanism includes a pin member and a ring member, the pin member being fixed to the driving-side wall and/or the driven-side wall and protruding toward the driven-side end plate and/or the driving-side end plate, and the ring member being fixed to the driving-side end plate and/or the driven-side end plate and including an inner peripheral surface coming into contact with the pin member, the driving-side end plate and/or the driven-side end plate includes a ring member installation hole into which the ring member is inserted and installed, and the ring member installation hole includes a non-wall-side hole part and a wall-side hole part, the non-wall-side hole part being formed from a non-wall-side surface of the driving-side end plate not provided with the driving-side wall and/or a non-wall-side surface of the driven-side end plate not provided with the driven-side wall and having a diameter corresponding to an outer diameter of the ring member, and the wall-side hole part being formed from a wall-side surface of the driving-side end plate provided with the driving-side wall and/or a wall-side surface of the driven-side end plate provided with the driven-side wall and having a diameter smaller than the outer diameter of the ring member.

2. The co-rotating scroll compressor according to claim 1, wherein a plurality of the driving-side walls are provided at predetermined angular intervals around a center of the driving-side end plate, the driven-side walls in a number corresponding to the number of driving-side walls are provided at predetermined angular intervals around a center of the driven-side end plate, and the pin member is provided in a range from a winding end of each of the driving-side walls and/or the driven-side walls to an angle that is obtained by dividing $\pi$(rad) by the number of the driving-side walls or the number of the driven-side walls.

3. The co-rotating scroll compressor according to claim 2, wherein the pin member is provided in an angle range excluding a position of each of the driving-side walls and/or the driven-side walls.

4. The co-rotating scroll compressor according to claim 3, wherein the pin member is provided on each of the driving-side wall and the driven-side wall.

5. The co-rotating scroll compressor according to claim 2, wherein the pin member is provided on each of the driving-side wall and the driven-side wall.

6. The co-rotating scroll compressor according to claim 1, wherein the pin member is provided on each of the driving-side wall and the driven-side wall.

* * * * *